United States Patent [19]

White et al.

[11] Patent Number: 5,074,319

[45] Date of Patent: Dec. 24, 1991

[54] TOBACCO EXTRACTION PROCESS

[75] Inventors: Jackie L. White, Pfafftown; Thomas A. Perfetti; Milly M. L. Wong, both of Winston-Salem, all of N.C.

[73] Assignee: R. J. Reynolds Tobacco Company, Winston-Salem, N.C.

[21] Appl. No.: 511,158

[22] Filed: Apr. 19, 1990

[51] Int. Cl.[5] ..... A24B 15/26

[52] U.S. Cl. ..... 131/298

[58] Field of Search ..... 131/297, 298

[56] References Cited

U.S. PATENT DOCUMENTS 3,110,315 11/1963 Lendvai .
3,136,321 9/1964 Davis .
3,316,919 5/1967 Green et al. .
3,424,171 1/1969 Rooker .
3,478,015 11/1969 Nishi .
3,894,543 7/1975 Anderson et al. .
4,421,126 12/1983 Gellatly .
4,506,682 3/1985 Muller .
4,605,016 8/1986 Soga .
4,756,318 7/1988 Clearman .
4,827,949 5/1989 Sunas .

*Primary Examiner*—V. Millin

[57] ABSTRACT

Flavorful tobacco-derived flavorful components of a tobacco material are provided by extraction of the tobacco material with an extraction solvent in the form of a polyhydric alcohol or ester thereof. The tobacco material is subjected to extraction conditions above about 100° C. and under conditions sufficient to provide the flavorful tobacco-derived extraction product. The tobacco material and the extraction solvent can be contacted in the presence of at least one reaction component such as at least one amino acid and/or at least one sugar.

11 Claims, 2 Drawing Sheets

TOBACCO EXTRACTION PROCESS

BACKGROUND OF THE INVENTION

The present invention relates to a process for providing flavorful tobacco-derived components extracted from tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al.; 4,756,318 to Clearman et al.; and 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouth-end piece. Such types of smoking articles provide natural tobacco flavors to the smoker thereof by heating, rather than burning, tobacco in various forms.

Natural tobacco flavors are important components of smoking articles. Such flavors enhance the tobacco taste and aroma of the smoking article into which the flavors have been incorporated. Thus, improved processes for providing natural tobacco flavor and aromatic substances, and flavorable and aromatic forms of tobacco are desirable. As a result, there has been interest in extracting particular components from tobacco. For example, various processes for producing and using tobacco extracts, aroma oils and concentrates are proposed in U.S. Pat. Nos. 3,136,321 to Davis; 3,316,919 to Green; 3,424,171 to Rooker; 4,421,126 to Gellatly and 4,506,682 to Mueller and European Patent No. 338,831 to Clapp et al.

Polyhydric alcohols have been used as humectants, particularly as casing components, in order to retain moisture and to increase flexibility of tobacco materials used as cut filler for cigarette manufacture. See, for example, *Tobacco Encyclopedia, edit. by Voges, TJI* (1984). Polyhydric alcohols have also been used as extraction solvents, as proposed in U.S. Pat. Nos. 3,110,315 to Lendvay; 4,605,016 to Saga et al and 4,827,949 to Sunas, and in U.S. Pat. Ser. No. 364,042 filed May 2, 1989 now U.S. Pat. No. 4,986,286 to Roberts, et al.

It would be highly desirable to provide a process for efficiently and effectively providing flavorful tobacco-derived components of tobacco material.

SUMMARY OF THE INVENTION

The present invention relates to a process for providing a tobacco-derived extraction product. In particular, tobacco material is subjected to extraction conditions sufficient to alter the chemical nature of the extract which is extracted from that tobacco material. The resulting extraction products are flavorful in character, and can be used with other forms of tobacco for various types of cigarettes and other smoking articles.

In one embodiment, the process involves providing a tobacco material and extraction solvent. The extraction solvent is in the form of at least one polyhydric alcohol or ester thereof (e.g., glycerin, propylene glycol, triacetin, etc). The extraction solvent is maintained at a temperature above about 100° C. and at atmospheric pressure. The tobacco material and the extraction solvent are contacted, and the tobacco material is submitted to extraction conditions sufficient to provide a tobacco-derived extraction product within the extraction solvent. The tobacco-derived extraction product within the solvent is separated from the extracted tobacco material and collected. The extraction product can be used as is, or can be used to extract at least one further amount of tobacco material.

In another embodiment, the tobacco material and extraction solvent are contacted with one another. The tobacco material is then subjected to extraction conditions above about 100° C. and at atmospheric pressure, and under conditions sufficient to provide a tobacco-derived extraction product within the extraction solvent. The tobacco-derived extraction products so provided include various extraction and reaction components which are extremely flavorful.

Optionally, in either embodiment, the tobacco material and the extraction solvent can be contacted in the presence of a reaction component (e.g., at least one amino acid and/or at least one sugar). The reaction components contribute to the flavorful characteristics of the extraction product.

The flavorful tobacco-derived extraction products are useful in manufacturing smoking products. For example, the products are useful on tobacco as casing or top dressing components for tobacco laminae, tobacco cut filler and for other smokable materials. Alternatively, such flavorful products are useful in those types of smoking articles described in U.S. Pat. Nos. 4,708,151 to Shelar; 4,714,082 to Banerjee et al; 4,756,318 to Clearman et al; and 4,793,365 to Sensabaugh et al; as well as European Patent Publication Nos. 212,234 and 277,519.

The flavorful products also are useful as cigarette filter additives and can be incorporated into low density polyethylene and formed into strands, and then incorporated into cigarette filters as described in U.S. Pat. Nos. 4,281,671 to Bynre et al and 4,862,905 to Green, Jr., et al. The products also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

DETAILED DESCRIPTION OF THE PREFERRED EMBODIMENTS

Figure 1:
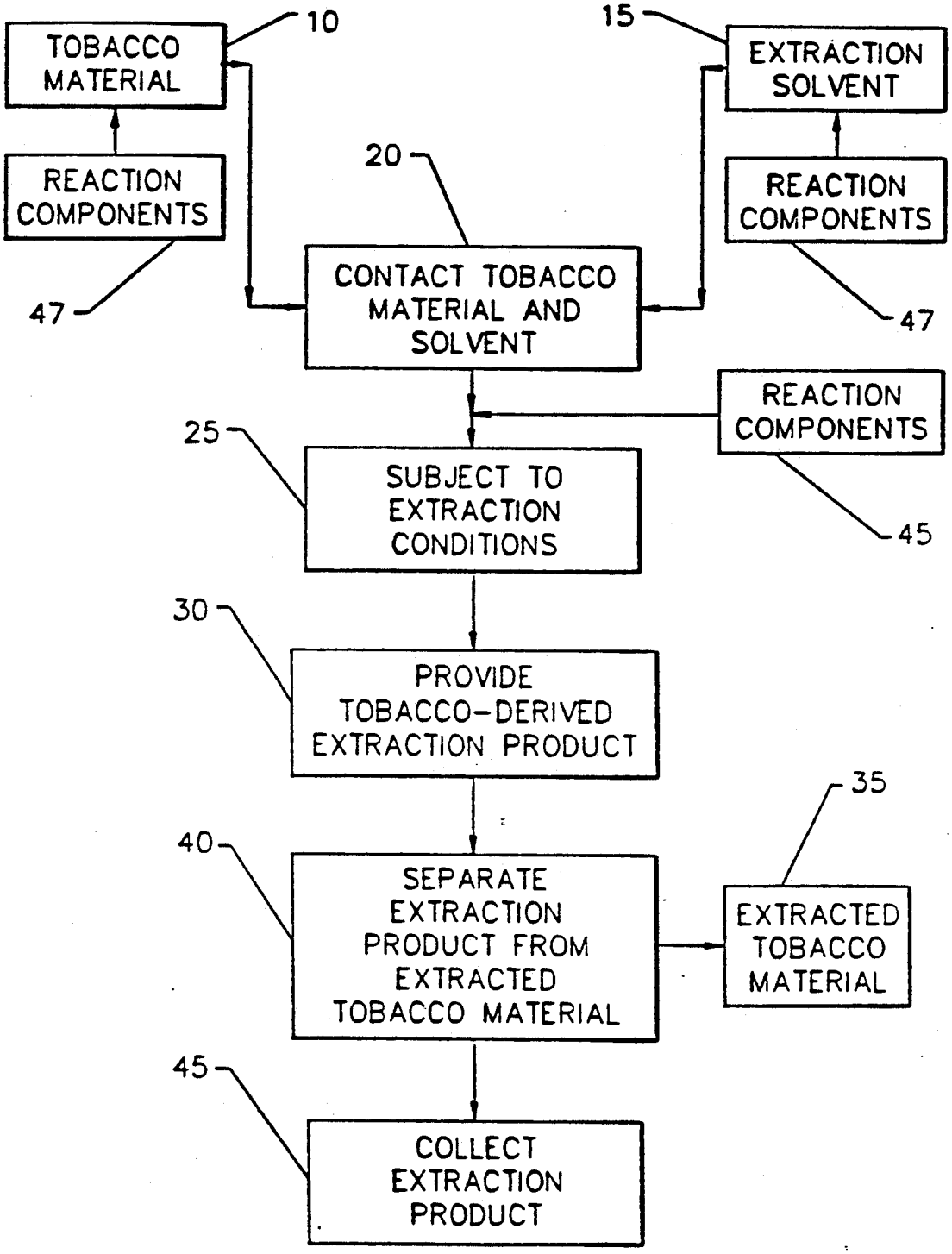
FIG. 1 is a schematic diagram of process steps of an embodiment of the present invention.

Referring to FIG. 1, tobacco material 10 and an extraction solvent 15 are contacted 20. The extraction solvent 15 preferably is at a temperature of above about 100° C. and at atmospheric pressure. The tobacco material 10 and the extraction solvent 15 are subjected 25 to extraction conditions sufficient to provide a tobacco-derived extraction product 30 within the extraction solvent 15. The extraction product 30 is then separated 40 from extracted tobacco material 35 (i.e. a residue not extracted by the solvent), and the extraction product is collected 45. Optionally, the tobacco material 10 and the extraction solvent 15 can be contacted in the presence of at least one reaction component 47.

Figure 2:
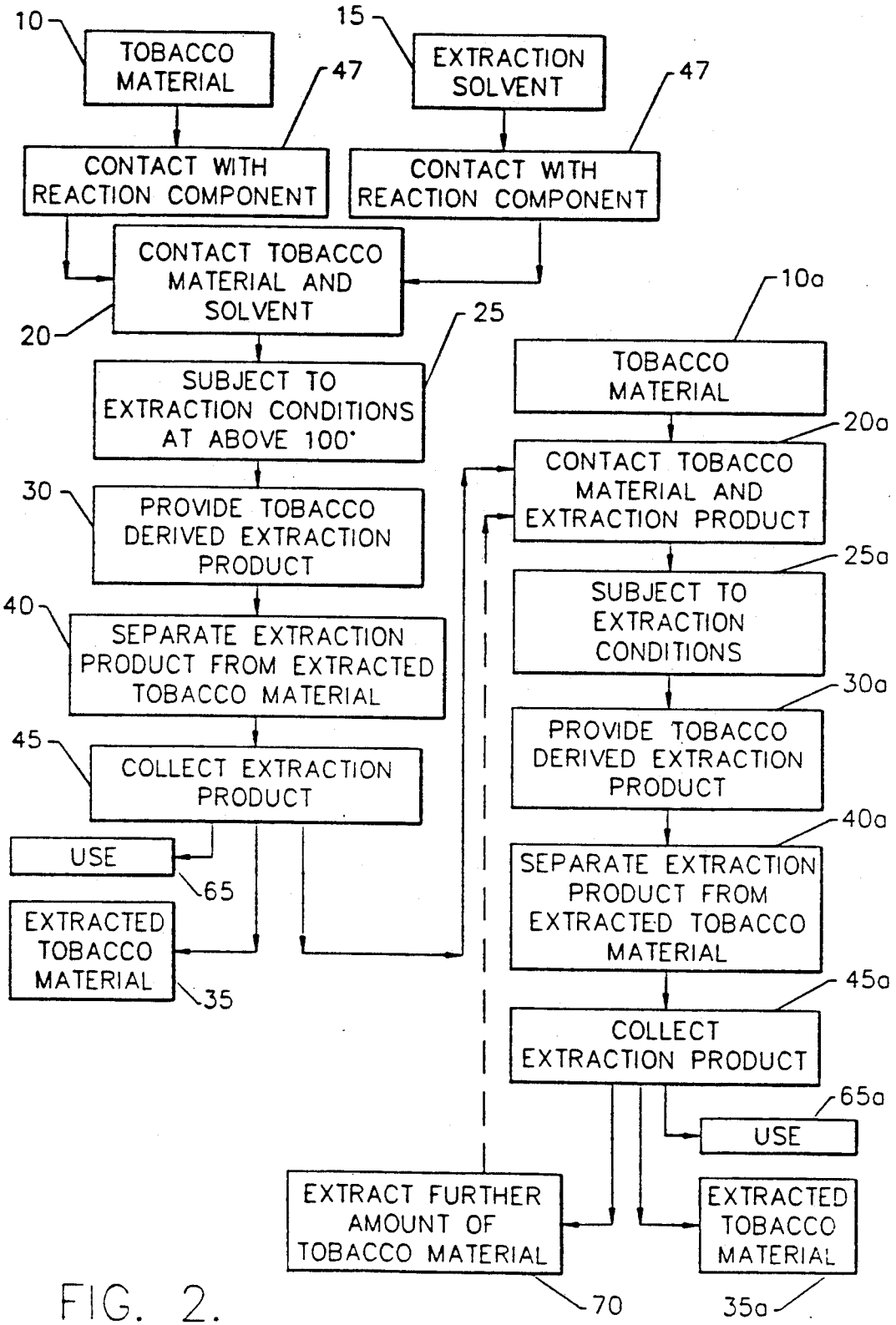
FIG. 2 is a schematic diagram of process steps of another embodiment of the present invention.

Referring to FIG. 2, another embodiment is illustrated with like numerals indicating aspects common to those in FIG. 1. The tobacco material 10 and the extraction solvent 25 are contacted 20. The tobacco material 10 is subjected 25 to extraction conditions above about 100° C. and at atmospheric pressure and under conditions sufficient to provide a tobacco-derived extraction product within the extraction solvent 15. The extraction product 30 is separated 40 from extracted tobacco material 35. The extraction product 30 can be used 65 as is, or at least one further amount of tobacco material 10*a* can be contacted 20*a* with the solvent including the extraction product. The tobacco material 20*a* is again subjected 25*a* to extraction conditions above about 100° C. and at atmospheric pressure, and under conditions sufficient to provide additional extraction product 30*a* within the extraction solvent. The extraction product 30*a* is then separated 40*a* from the extracted tobacco material 35*a* and collected 45*a*. The extraction product can be used as is 65*a* or can be used to extract 70 a further amount of tobacco material.

The tobacco materials useful herein can vary. Tobacco materials are of a form such that under extraction conditions, a portion thereof is soluble in (i.e., extracted by) an extraction solvent; and a portion thereof is insoluble in (i.e., not extracted by) that extraction solvent. A typical insoluble tobacco material includes components of the biopolymer matrix of the tobacco (e.g., cellulosics).

Examples of suitable types of tobaccos include flue-cured, Burley, Maryland and Oriental tobaccos, as well as the rare or specialty tobaccos. The tobacco material generally has been aged, can be in the form of laminae and/or stem, and can be in processed form. For example, processed tobacco material such as volume expanded, ammoniated, heat treated and/or reconstituted tobacco materials can be employed. The tobacco material can be cased or top dressed if desired. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof.

The tobacco material is extracted with an extraction solvent. The extraction solvent is at least one polyhdric alcohol or ester thereof having a high boiling point (i.e., greater than about 100° C.). Exemplary polyhydric alcohols or esters thereof include glycerin, propylene glycol, triacetin, triethylene glycol, tetraethylene glycol, and triethylene glycol triaceteate. The extraction solvent can be a mixture of polyhydric alcohols or esters thereof, or can include minor amounts (e.g., up to about 10% by weight of dry tobacco material) of other solvents. The extraction solvent can also include flavorants, pH buffers, pH adjusters, organic and inorganic salts and surfactants.

The tobacco material and the extraction solvent are contacted and subjected to extraction conditions sufficient to provide a tobacco-derived extraction product. Preferably these extraction conditions include providing the extraction solvent at a temperature above about 100° C. and at atmospheric pressure, preferably from about 120° C. to 180° C. and often above 155° C. to about 165° C. and maintaining the temperature throughout the step of contacting the tobacco material and extraction solvent. Typically temperatures do not exceed about 270° C. The extracted product include flavorful tobacco-derived components extracted from the tobacco material as well as the flavorful reaction products of those components. Typically, those reaction products are the result of the Maillard reactions.

Optionally, the tobacco material and the extraction solvent can be contacted in the presence of a reaction component (e.g., at least one amino acid and/or at least one sugar) The reaction component facilitates the Maillard reactions. The Maillard reactions or "browning reactions" are reactions between (i) the amino substituents of amino acids, peptides, proteins or other nitrogen-containing compounds, and (ii) the carbonyl group of a sugar in the reducing form or other carboxyl-containing compounds. See, Maillard, Ana. Chim., Vol. 9, pp. 5 and 258 (1916); Hodge, *J. Aoric. Food Chem.*, Vol. 1, p. 928 (1953); Nursten, *Food Chem.*, Vol. 6, p. 263 (1981) and Waller et al, *ACS Symp. Ser.* (1983). Such reactions result in a significant darkening of the tobacco reaction product, typically to an extremely dark brown color. Exemplary reaction components preferably include at least one amino acid, amino acid analog or amino acid source (e.g., glutamine, asparagine, proline, alanine, cystine, aspartic acid, phenylalanine, glutamic acid) and/or at least one sugar or sugar source (e.g., fructose, sucrose, glucose, maltose). The reaction component also can include a reaction promoter, for example, a base such as anhydrous ammonia gas, sodium hydroxide, potassium hydroxide, ammonium hydroxide, sodium carbonate, potassium carbonate, ammonium carbonate, potassium bicarbonate, sodium bicarbonate, potassium bicarbonate and ammonium bicarbonate.

The resulting tobacco-derived flavorful extraction product is then collected for use by separating the extraction product from the extracted tobacco material (i.e. the residue is deliquored). The manner of separation can vary; however, it is convenient to employ conventional separation techniques involving the use of filters, centrifuges, screw presses, converging belts, rotating disk presses, and the like. Additionally the extraction solvent and the extraction product can be separated from one another using an extraction solvent such as supercritical carbon dioxide.

The extraction product can be used as is within a smoking article or can be used to extract at least one further amount of tobacco material. The tobacco material tends to be more soluble in the extraction product within the solvent. Extraction conditions are typically continued until the extraction product has the desired aroma and flavor profile. Subjective characteristics such as the aroma or flavor can vary, and typically increases as additional amounts of tobacco material are extracted. Color of the extraction product provides a visual indication of the level of the aroma and the flavor, with a darker color being indicative of stronger aroma and flavor.

The collected flavorful tobacco-derived extraction product within the extraction solvent can be used as is in various forms in the manufacture of smoking articles. For example, the flavorful products can be employed as a form of tobacco in smoking article manufacture. For example, tobacco cut filler, as well as the types of smokable materials described in U.S. Pat. application Ser. No. 276,161, filed Nov. 23, 1988, now U.S. Pat. No. 4,920,990 to Lawrence et al can be coated with about 0.001 to about 1 percent by weight of the tobacco-derived components, based on the weight of the particular smokable material. In addition, the coated tobacco can be incorporated into those smoking articles described in U.S. Pat. application Ser. No. 414,833 filed Sept. 29, 1989 and European Patent Publication No. 280,990. Furthermore, the flavorful products can be carried by a substrate such as silica or alumina, and employed in the manufacture of those smoking articles described in U.S. Pat. Nos. 4,708,151 to Shelar; 4,771,795 to White et al; 4,714,082 to Banerjee et al; 4,756,318 to Clearman et al; and 4,793,365 to Sensabaugh et al; as well as European Patent Publication Nos. 212,234 and 277,519.

The following examples are provided in order to further illustrate various embodiments of the invention but should not be construed as limiting the scope thereof. Unless otherwise noted, all parts and percentages are by weight.

EXAMPLES

EXAMPLE 1

A 75 g sample of an "American" blend of tobacco material in cut filler form at 32 cuts per inch and which has been cased and top dressed is placed in an elongated tube of about 25 inches in length and about 2 inches inner diameter. The tube preferably is insulated with heat tape. Extraction solvent in the form of 600 g of glycerin is heated in a round bottom flask equipped with a heating mantle. The extraction solvent is heated under extraction conditions at a temperature of 160°C. ± 5° C. and at atmospheric pressure, and is pumped by a peristaltic pump to the top of the tube. The extraction solvent is then dripped through the tube and contacted with the tobacco material for one hour. The insulated tube is maintained at a temperature of 160° C. ± 5° C. The resulting tobacco-derived extraction product within the glycerin is separated from the extracted tobacco material with a hand press, and is collected in the round bottom flask. The tobacco-derived extraction product within the glycerin is pumped back by the pump to the tube, and a fresh 75 g sample of the tobacco material is loaded into the tube. The fresh sample is extracted and separated as previously, and the tobacco-derived extraction product within the glycerin is collected.

EXAMPLE 2

A 75 g sample of the tobacco material of Example 1 is placed in the tube. The extraction solvent is in the form of 600 g of glycerin, and includes a reaction component in the form of 40 g of aspartic acid. The extraction solvent is used to extract two 75 g samples of tobacco material, is separated and collected as described in Example 1.

EXAMPLE 3

A 75 g sample of the tobacco material of Example 1 is placed in the tube. The extraction solvent is in the form of 600 g of glycerin, and includes a reaction component in the form of 40 g of alanine. The extraction solvent is used to extract two 75 g samples of tobacco material, is separated and collected as described in Example 1.

EXAMPLE 4

A 75 g sample of the tobacco material of Example 1 is placed in the tube. The extraction solvent is in the form of 600 g of glycerin, and includes a reaction component in the form of 40 g of asparagine. The extraction solvent is used to extract two 75 g samples of tobacco material, is separated and collected as described in Example 1.

EXAMPLE 5

A 75 g sample of the tobacco material of Example 1 is placed in the reaction vessel. The extraction solvent is in the form of 600 g of glycerin, and includes a reaction component in the form of 40 g of glutamine. The extraction solvent is used to extract two 75 g samples of tobacco material, is separated and collected as described in Example 1.

EXAMPLE 6

A 75 g sample of the tobacco material of Example 1 is placed in the tube. The extraction solvent is in the form of 600 g of propylene glycol, and includes a reaction component in the form of 40 g of aspartic acid. The extraction solvent is used to extract two 75 g samples of two 75 g samples of tobacco material, is separated and collected as described in Example 1.

EXAMPLE 7

A 75 g sample of the tobacco material of Example 1 is placed in the tube. The extraction solvent is in the form of 600 g of triacetin, and includes a reaction component in the form of 40 g of aspartic acid. The extraction solvent is used to extract two 75 g samples of tobacco material, is separated and collected as described in Example 1.

That which we claim is:

1. A process for providing a tobacco-derived extraction product, the process comprising:

(a) providing an unextracted tobacco material;

(b) providing an extraction solvent in the form of at least one polyhydric alcohol or ester thereof at a temperature above about 100° C. and at atmospheric pressure;

(c) contacting the tobacco material and the extraction solvent which is at a temperature above about 100° C. and at atmospheric pressure and subjecting the tobacco material to extraction conditions sufficient to provide a tobacco-derived extraction product within the extraction solvent; and (d) separating the tobacco-derived extraction product within the extraction solvent from the extracted tobacco material.

2. A process according to claim 1 whereby the extraction product within the extraction solvent so provided in step (d) is employed to extract at least one further amount of unextracted tobacco material.

3. A process according to claim 1 whereby step (c) is performed in the presence of at least one reaction component.

4. A process according to claim 1 whereby the extraction solvent provided in step (b) is maintained at a temperature of from about 120° to about 180° C. and at atmospheric pressure, and is maintained at that temperature throughout the extraction conditions of step (c).

5. A process according to claim 1 whereby the polyhydric alcohol or esters thereof includes glycerin, propylene glycol and/or triacetin.

6. A process for providing a tobacco-derived extraction product, the process comprising:

(a) providing an unextracted tobacco material;

(b) providing an extraction solvent in the form of at least one polyhydric alcohol or ester thereof at a temperature above about 100° C. and at atmospheric pressure;

(c) contacting the tobacco material and the extraction solvent which is at a temperature above about 100° C. and at atmospheric pressure and subjecting the tobacco material to extraction conditions sufficient to provide a tobacco-derived extraction product within the extraction solvent; and (d) separating the tobacco-derived extraction product within the extraction solvent from the extracted tobacco material.

7. A process according to claim 6 whereby the tobacco extraction product within the solvent so provided in step (d) is employed to extract at least one further amount of unextracted tobacco material.

8. A process according to claim 6 whereby step (c) is performed in the presence of at least one reaction component which includes at least one amino acid, amino acid analog or amino acid source and/or at least one sugar, sugar analog or sugar source.

9. A process according to claim 8 whereby the reaction component is added to the extraction solvent prior to contacting the tobacco material and the extraction solvent.

10. A process according to claim 6 whereby the extraction solvent provided in step (b) is maintained at a temperature of from about 120° to about 180° C. and at atmospheric pressure, and is maintained at that temperature throughout the extraction conditions of step (d).

11. A process according to claims 6 whereby the polyhydric alcohol or ester thereof includes glycerin, propylene glycol and/or triacetin.

* * * * *